United States Patent [19]

Mabuchi

[11] 4,258,499

[45] Mar. 31, 1981

[54] ELECTRICALLY-OPERATED MOBILE MODEL TOY

[75] Inventor: Kenichi Mabuchi, Matsudo, Japan

[73] Assignee: Mabuchi Motor Co. Ltd., Tokyo, Japan

[21] Appl. No.: 17,093

[22] Filed: Mar. 5, 1979

[30] Foreign Application Priority Data

Mar. 15, 1978 [JP] Japan ..... 53/29737
Mar. 15, 1978 [JP] Japan ..... 53/33239[U]

[51] Int. Cl.[3] ..... A63H 33/26
[52] U.S. Cl. ..... 46/232; 46/251
[58] Field of Search ..... 46/232, 248, 251, 254, 46/252, 253, 255

[56] References Cited

U.S. PATENT DOCUMENTS

| | | | |
|---|---|---|---|
| 3,190,034 | 6/1965 | Ryan | 46/232 X |
| 3,286,396 | 11/1966 | Ryan | 46/232 |
| 4,094,094 | 6/1978 | Ono | 46/232 |

FOREIGN PATENT DOCUMENTS

| | | | |
|---|---|---|---|
| 1024859 | 2/1958 | Fed. Rep. of Germany | 46/248 |
| 1523670 | 9/1978 | United Kingdom | 46/232 |

*Primary Examiner*—Gene Mancene
*Assistant Examiner*—Mickey Yu

[57] ABSTRACT

An electrically-operated mobile model toy which carries in it a drive motor and a DC power source to feed to the drive motor and is moved by the driving force of the drive motor is disclosed, wherein a start control device and an imitation sound generator to generate an imitation sound as the drive motor rotates are provided, the start control device being provided between a driving section driven by the drive motor and a driven section and so constructed that it can transmit the driving force of the driving section to the driven section when the number of revolutions of the drive motor exceeds a preset level, the imitation sound generator being provided between the drive motor and the start control device.

5 Claims, 4 Drawing Figures

ELECTRICALLY-OPERATED MOBILE MODEL TOY

BACKGROUND OF THE INVENTION

1. Field of the Invention

The present invention relates to an electrically-operated mobile model toy, more particularly an electrically-operated model car with a radio control, wherein an imitation sound generator and a start control device are provided so that the imitation sound generator can produce imitation sounds closely resembling engine sounds produced by full-scale automobiles as an ordinary means of transportation even when the electrically-operated model car is at a standstill.

2. Description of the Prior Art

It has generally been noted that funs of electrically-operated mobile model toys such as electrically-operated model cars, planes and ships have increasingly become inclined to prefer radio-controlled ones. Conventionally, these electrically-operated mobile model toys use in most cases a plurality of dry cells connected in series or batteries to drive motors to rotate wheels, propellers or screws. The logical consequence of such a drive mechanism is extremely low noises producible from the electrically-operated mobile model toys. For many funs of radio-controlled, electrically-operated mobile model toys, however, it is of course preferable that the operating condition of the electrically-operated mobile model toys is as close as possible to that of full-scale automobiles, planes and ships. More precisely, in case of an electrically-operated model car, for example, it is desirable that it can produce imitation sounds well matching the changing state of operation—racing the engine with a loud roar before starting or driving at varying driving speeds, and even simulate a small vibration as seen in actual cars before starting.

SUMMARY OF THE INVENTION

It is an object of the present invention to provide an electrically-operated mobile model toy which is designed taking the above-mentioned respects into consideration to provide a sense of presence obtainable heitherto only from actual cars even when it is at a standstill before starting.

Accordingly, it is an object of the present invention to provide an electrically-operated mobile model toy in which an imitation sound generator and a start control device are provided so that user of electrically-operated mobile model toys embodying the present invention can feel as a sense of presence the state of stoppage of the electrically-operated mobile model toy by enjoying sounds closely imitating engine sounds, for example.

In accordance with the above object, it is an object of the present invention to provide an unbalance/balance unit which makes the body of an electrically-operated mobile model toy vibrate slightly when it is in the "stop" state so as to produce a sense of presence which has hitherto been obtainable only from an actual automobile.

DETAILED DESCRIPTION OF THE INVENTION

Figure 4:
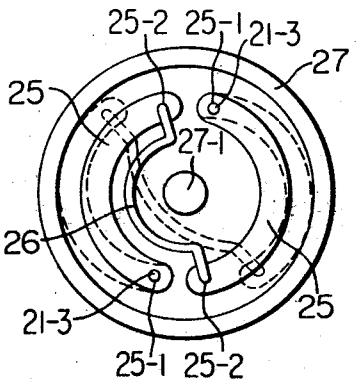

In FIGS. 1 to 4, numeral 1 represents a base plate of the chasis, 2-1 and 2-2 front wheels, 3-1 and 3-2 rear wheels, 4 a connecting rod to connect levers 2-3 and 2-4 which operate in association with the front wheels 2-1 and 2-2, 5 a interlocking rod, 6 a servo-motor and 7 a working shaft of the servo-motor 6 which operates the interlocking rod 5 via the lever 2-3 or operates the lever 2-4 via the connecting rod 4.

Numeral 8 is a DC power source consisting of batteries, etc., 9 a receiver, 10 a cylinder or a cylindrical, polyhedral hollow box, 11 a striking rod, 12 a striking face, 13 a striking rod holder, 14 a curved top end of the striking rod 11 to strike the striking face 12 and 15 a bottom end of the striking rod 11. The striking rod 11 is held in position through the striking rod holder and the curved top end 14 is in contact with the striking face 12 on the hollow box 10. The striking rod 11, striking face 12 and hollow box 10 comprise an imitation sound generator of the present invention.

Numeral 16 represents a speed controller, 17 a drive motor, and 18 a rotating shaft of the drive motor 17. The said power source 8 supplies electric power to the receiver 9 and the servo-motor 6 fixed on the chasis base plate 1 and to the drive motor 17 via the speed controller 16.

Numeral 19 is an operating disc which actuates the striking rod 11 and 20 a small operating ring. The small operating ring 20 is secured in position to the operating disc 19 by a set screw 20-1 and is disposed so as to flip the bottom end 15 of the striking rod 11 as the operating disc 19 rotates. Into a center hole 19-2 provided on a center axis 19-1 of the operating disc 19 is inserted the rotating shaft 18, and the operating disc 19 is secured in position by a screw 19-3 to the drive motor 17. Additionally, a protrusion 19-4 is provided on the other side of the operating disc 19 to receive a balance weight which will later be discussed.

Numeral 21 represents a clutch base in the upper half of which two openings 21-1 and and 21-1 and a center axis 21-2 are provided. Numeral 22 indicates a balance weight which has a vertical opening 22-1 in its center and is supported at its bottom on an approximately diamond-shaped, elastic supporting rod 22-2. A shaft screw 23 is inserted through the said vertical opening 22-1 and secured in position in the upper half of the clutch base 21, its bottom end 22-3 resting on the said protrusion 19-4 so that the said balance weight 22 can move freely upward and downward through the vertical opening 22-1. The supporting rod 22-2 is secured in position by a set screw 24 to the lower half of the clutch base 21 so that the balance weight 22 may be pulled centripetally by the elasticity of the supporting rod 22-2, and the unbalance/balance unit consisting of the clutch base 21 and the balance weight 22 may be balanced when the balance weight 22 moves upward centrifugally through the vertical opening 22-1 against the elasticity of the supporting rod 22-2 to reach the upper limit.

Numeral 25 represents clutch shoes which, together with a clutch bell later discussed, comprises a start control device. Numeral 26 refers to a clutch spring. Numeral 27 indicates a shallow cylindrical clutch ball one side of which is opened, the clutch shoes 25 and 25 being rotatably supported on the protrusions 21-3 and 21-3 provided on the clutch base 21 at one end 25-1 as shown clearly in FIG. 4. Both ends of the clutch spring 26 are inserted into insertion holes 25-2 and 25-2 provided at the other end of the clutch shoes 25 and 25 so that the elasticity of the clutch spring 26 may allow the clutch shoes 25 and 25 to be closed (as illustrated by solid lines in FIG. 4). In the clutch bell 27 housed are the clutch shoes 25 and 25 which are disposed so as to be covered with the clutch base 21. The center axis 21-2 of the clutch base 21 passes loosely through a center hole 27-1 of the clutch bell 27 and a center cavity 25-3 of the clutch shoes 25 and 25 and further passes loosely through a gear 28 on the opposite side of the clutch bell 27. The clutch bell 27 is secured in position unremovably by a nut 31 indicated in FIG. 1 via an E ring 30. In other words, the said clutch bell 27 and gear 28 are supported rotatably with respect to the said center axis 21-2, and the gear 28 transmits rotating force to the rear wheels 3-1 and 3-2 via a differential gear 29, etc.

The operation of the present invention which is constructed as above-stated will now be explained.

Figure 1:
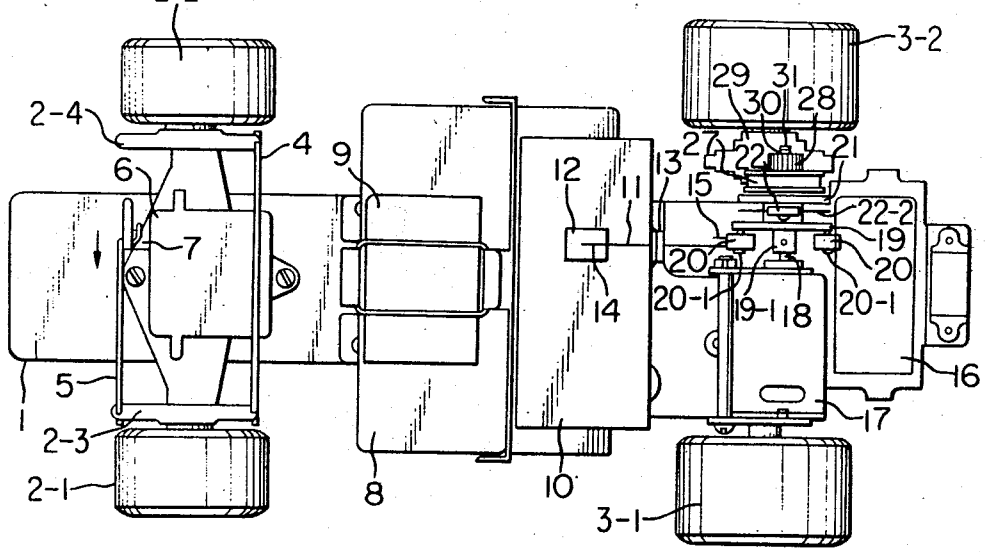
FIG. 1 is a top view of the chasis with its exterior detached of a radio-controlled car which represents a typical embodiment of the present invention, FIG. 2 an exploded perspective view of the drive motor section of the said embodiment, FIG. 3 an illustration which explains the operating principle of the unbalance/balance unit of the said embodiment and FIG. 4 an illustration which explains the operating principle of the clutch show of the said embodiment.
Figures 2, 3:
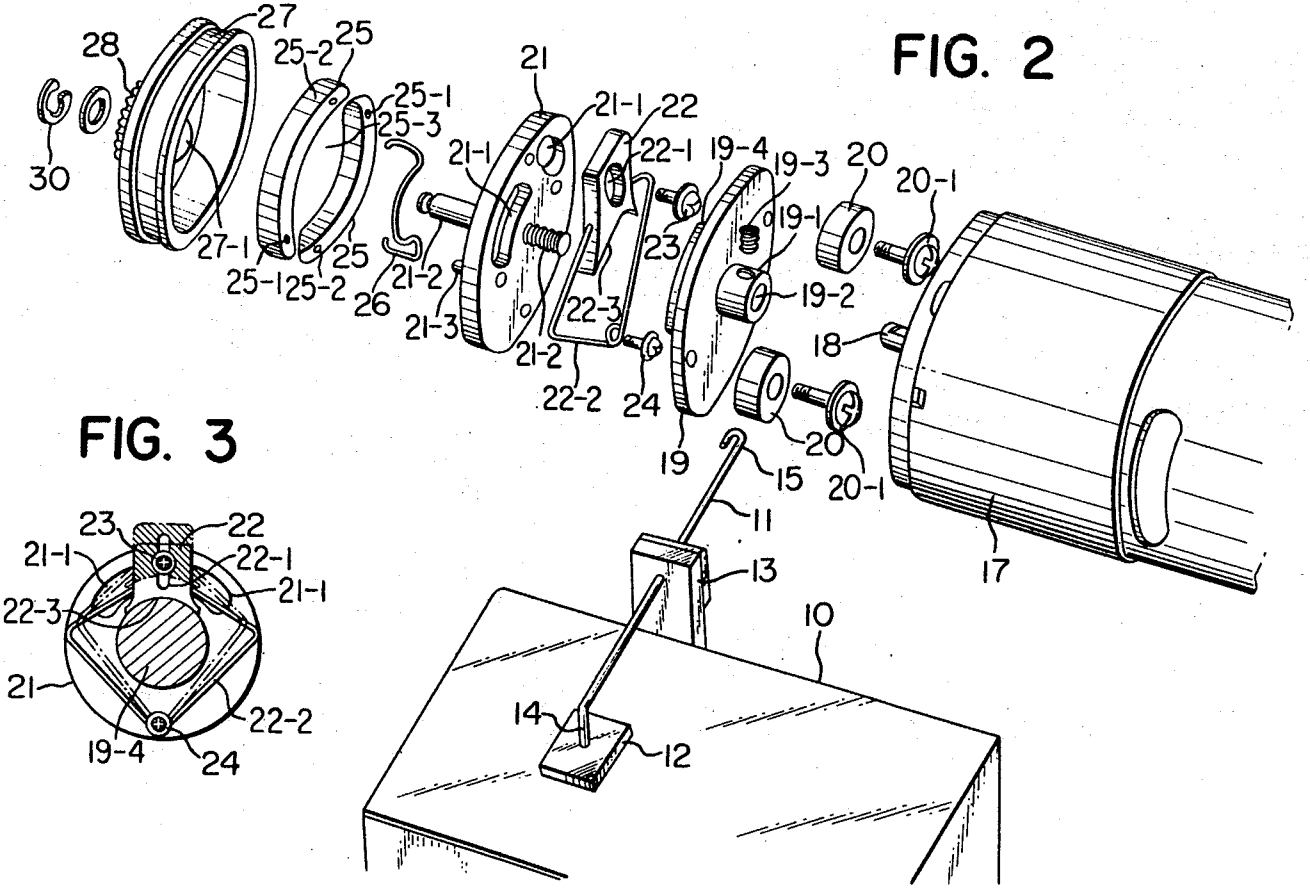

As illustrated in FIG. 1, when the drive motor 17 is turned on to rotate by controlling the speed controller 16 using operation signal received by the receiver 9, the operating disc 19 fixed on the rotating shaft 18 begins to rotate as the drive motor 17 rotates. Then, the small operating rings 20 and 20 mounted on the operating disc 19 move along the circumference and flip the bottom end 15 of the striking rod 11 twice for every revolution of the operating disc 19. To this end, the striking rod 11 is adapted to vibrate vertically due to the elasticity of the striking rod 11 and allow the curved top end 14 to strike the striking face 12 of the hollow box 10. As a result, the hollow box 10 produces sound of mixed tones. The basic frequency of the sound thus produced increases linearly with the number of revolutions of the drive motor 17, a secret for the close sound imitability of the present invention, e.g., a loud roar before engine-start or drumming sounds at high r.p.m.

As the operating disc 19 rotates and the hollow box 10 produces engine sounds, the clutch base 21 connected to the said operating disc 19 by the center axis 21-1 also begins to rotate. When the drive motor 17 rotates at low speeds, the balance weight 22 is located low as illustrated by solid lines in FIG. 3. Because of this, an imbalance will be produced in the unbalance/-balance unit between the upper half and lower half as illustrated, thereby causing the body to vibrate. This vibration resembles very closely the slight vibration encounted by actual automobiles when revving up the engine in the "stop" state. In this state, the clutch shoes 25 and 25 secured at their ends 25-1 and 25-1 to the clutch base 21 also rotate, but they run idle in the clutch bell 27 because the centrifugal force is not strong enough to make them open against the clutch spring 26 as illustrated by dotted lines in FIG. 4 and, for the same reason, the clutch bell 27 will not rotate. Therefore, the rear wheels 3-1 and 3-2 interlocked with the gear 28, etc. will not rotate, thus making the body standstill. As the number of revolutions of the drive motor 17 rises, the sound produced from the hollow box will become louder and simultaneously the unbalance/balance unit will rotate at increasing speeds, thus causing the balance weight 22 to move upward through the vertical opening 22-1. When the r.p.m. of the drive motor 17 reaches a preset level, the clutch shoes 25 and 25 which rotate in association with the clutch base 21 will become increasingly opened as illustrated by dotted lines in FIG. 4 against the elasticity of the clutch spring 26 to come in contact with the inner wall of the clutch bell 27. As a consequence, the clutch bell 27 will be driven to rotate by the frictional linkage of the clutch shoes 25 and 25 and make the rear wheels 3-1 and 3-2 rotate via the gear 28 and the differential gear 29 as shown clearly in FIG. 1. Thus, the radio-controlled car starts with a roaring sound, reaching a driving state. In this running state, the balance weight reaches an upper limit and the unbalance/balance unit becomes balanced, thus eliminating virtually vibration of the body.

Turning the radio-controlled car from its course can be accomplished by driving the servo-motor 6 by the drive signal from the receiver 9 which has received the operation signal to actuate the working shaft 7 as illustrated, for example, by the black arrow in FIG. 1. By doing this, the direction of the front wheels 2-1 and 2-2 which operate in association with the levers 2-3 and 2-4 will be changed in a well known fashion. In this case, more precisely, the radio-controlled car will turn to the downward direction illustrated in the figure.

As explained in the above, with the present invention, operators of an electrically-operated model car with a radio control, for example, can enjoy an exciting sense of presence as if they were a real driver of a real car throughout the driving cycle from start to stop since the present invention features an imitation sound generator that can produce sounds closely resembling those from actual car engines. Further, the unbalance/balance unit incorporated in the present invention makes it possible to make, for example, the body vibrate to a relatively large extent when, for example, the motor begins to be driven, decrease the vibration as the number of motor revolutions increases and virtually eliminate the vibration at the time of starting. In other words, operators of an electrically-operated model car, for example, embodying the present invention can enjoy the changing vibration of the body an ordinary car, for example, from "engine-key ON" to "engine Start". Thus, the present invention makes it possible for operators of electrically-operated mobile model toys to have a lifelike feeling of their standstill state, in particular.

What is claimed is:

1. An electrically-operated mobile model toy having a drive motor and a DC power source to feed said drive motor and which is moved by the driving force of the drive motor, wherein a start control device and an imitation sound generator to generate an imitation sound as the drive motor rotates are provided, the start control device being provided between a driving section driven by the drive motor and a driven section and being formed that it can transmit the driving force of the driving section to the driven section when the number of revolutions of the drive motor exceeds a preset level, the imitation sound generator being provided between the drive motor and the start control device, said start control device including two clutch shoes which are provided in said driving section and rotate in response to the driving force of said drive motor and a clutch bell which is provided in said driven section, houses said clutch shoes and is rotatably fitted to the extended shaft of a rotating shaft of said drive motor, said clutch shoes being so formed that they will come in contact with the inner wall of said clutch bell because of the centrifugal force exerted by the rotation of said drive motor and will be linked frictionally to said clutch bell when the number of revolutions of said drive motor reaches said preset level, said imitation sound generator including a striking rod one end of which is flipped by the driving force of said drive motor and the other end of which has a striking face, and a hollow box disposed opposite to said striking face, and is so formed that said striking rod will vibrate to strike said hollow box in response to the number of revolutions of said drive motor, said electrically-operated mobile model toy being an electrically-operated model car with a radio control wherein a receiver, a servo-motor to control the running direction and a speed controller to conrol the running speed are provided and wherein there is further provided an unbalance/balance unit consisting of a clutch base disposed imbalanced with respect to the rotating shaft of said drive motor and a balance weight which is supported on said clutch base by an elastic supporting rod and is movable radially by centrifugal forces, said unbalance/balance unit being adapted to impart vibration to the body of said electrically-operated mobile model toy when said drive motor is running at low speeds and suppress said vibration while said drive motor is running at high speeds.

2. An electrically-operated mobile model toy as defined in claim 1, wherein said unbalance/balance unit includes a clutch base consisting of a disc having an opening in one half of it and a balance weight supported elastically in response to the opening provided in the one half of said disc, said clutch base being provided with a vertical opening which makes said balance weight radially movable by centrifugal forces, and said balance weight being fitted movably to said clutch base via said vertical opening.

3. An electrically-operated mobile model toy as defined in claim 1, wherein said unbalance/balance unit includes a clutch base consisting of a disc having an opening in one half of it and a balance weight supported elastically in response to the opening provided in the one half of said disc, said clutch base being provided with a vertical opening which makes said balance weight radially movable by centrifugal forces, and said balance weight being fitted mobably to said clutch base via said vertical opening.

4. An electrically-operated mobile model toy having a drive motor and a DC power source to feed said drive motor and which is moved by the driving force of the drive motor, wherein a start control device and an imitation sound generator to generate an imitation sound as the drive motor rotates are provided, the start control device being provided between a driving section drive by the drive motor and a driven section and being so formed that it can transmit the driving force of the driving section to the driven section when the number of revolutions of the drive motor exceeds a preset level, the imitation sound generator being provided between the drive motor and the start control device, said start control device including two clutch shoes which are provided in said driving section and rotate in response to the driving force of said drive motor and a clutch bell which is provided in said driven section, houses said clutch shoes and is rotatably fitted to the extended shaft of a rotating shaft of said drive motor, said clutch shoes being so formed that they will come in contact with the inner wall of said clutch bell because of the centrifugal force exerted by the rotation of said drive motor and will be linked frictionally to said clutch bell when the number of revolutions of said drive motor reaches said preset level, said imitation sound generator including a striking rod one end of which is flipped by the driving force of said drive motor and the other end of which has a striking face, and a hollow box disposed opposite to said striking face, and is so formed that said striking rod will vibrate to strike said hollow box in response to the number of revolutions of said drive motor and wherein there is further provided an unbalance/balance unit consisting of a clutch base disposed imbalanced with respect to the rotating shaft of said drive motor and a balance weight which is supported on said clutch base by an elastic supporting rod and is movable radially by centrifugal forces, said unbalance/balance unit being adapted to impart vibration to the body of said electrically-operated mobile model toy when said drive motor is running at low speeds and suppress said vibration while said drive motor is running at high speeds.

5. An electrically-operated mobile model toy as defined in claim 4, wherein said unbalance/balance unit includes a clutch base consisting of a disc having an opening in one half of it and a balance weight supported elastically in response to the opening provided in the one half of said disc, said clutch base being provided with a vertical opening which makes said balance weight radially movable by centrifugal forces, and said balance weight being fitted mobably to said clutch base via said vertical opening.

* * * * *